United States Patent [19]

Wescott, Sr.

[11] Patent Number: 5,056,165

[45] Date of Patent: Oct. 15, 1991

[54] COMMODE FLUSH AND SEAT LIFT APPARATUS

[76] Inventor: Reginald E. Wescott, Sr., 3405 W. Clearfield St., Philadelphia, Pa. 19132

[21] Appl. No.: 550,062

[22] Filed: Jul. 9, 1990

[51] Int. Cl.[5] ..... E03D 5/08; A47K 13/10

[52] U.S. Cl. ..... 4/249; 4/251

[58] Field of Search ..... 4/250, 251, 249

[56] References Cited

U.S. PATENT DOCUMENTS

| | | | |
|---|---|---|---|
| 1,585,557 | 5/1926 | Miller | 4/249 |
| 1,616,509 | 2/1927 | Rehn | 4/251 |
| 2,329,240 | 9/1943 | Bendon et al. | 4/251 |
| 4,007,499 | 2/1977 | Lin | 4/249 |
| 4,807,307 | 2/1989 | Sato et al. | 4/251 |

FOREIGN PATENT DOCUMENTS

| | | | |
|---|---|---|---|
| 648960 | 8/1937 | Fed. Rep. of Germany | 4/249 |

*Primary Examiner*—Charles E. Phillips
*Attorney, Agent, or Firm*—Leon Gilden

[57] ABSTRACT

An apparatus including a conduit arrangement directing linkage to individually and selectively lift a toilet seat in cooperation with a flush lever of a commode organization to minimize manual contact with the commode apparatus.

7 Claims, 6 Drawing Sheets

PRIOR ART 24
23
17
21
18
22
5
16
6
15
7
19
20

COMMODE FLUSH AND SEAT LIFT APPARATUS

BACKGROUND OF THE INVENTION

1. Field of the Invention

The field of invention relates to commode apparatus, and more particularly pertains to a new and improved commode flush and seat lift apparatus wherein the same selectively permits manipulation of a commode flush lever and seat minimizing manual contact with the commode organization.

2. Description of the Prior Art

In contemporary life-styles, a commode organization provides a basis for transmittal of various disease of viral and bacteriological origin. The instant invention sets forth an organization wherein through selective utilization of a plurality of pedal members, manipulation of a commode seat and flush lever are available to individuals. Further, the organization permits individuals of limited physical capacity to manipulate the commode seat and flush lever in a manner consistent with such individuals of limited or diminished physical capacity. Examples of prior art commode accessory structure may be found in U.S. Pat. No. 1,614,346 to Coret wherein a pedal assembly is operatively associated with a chain member to actuate a flush valve of a commode tank structure.

U.S. Pat. No. 4,534,073 to Smith sets forth a pedal assembly cooperative with a toilet lid to effect lifting of the lid and seat structure relative to an associated commode.

U.S. Pat. No. 4,847,924 to Samaniego includes a foot pedal that may be selectively activated to displace a flush handle to effect actuation of the flush handle of a commode.

U.S. Pat. No. 4,649,576 to Lilie sets forth a foot actuated toilet seat lifter utilizing a pivotal triangulated lever to effect lifting of a toilet seat lid structure.

As such, it may be appreciated that there continues to be a need for a new and improved commode flush and seat lift apparatus wherein the same addresses both the problems of ease of use, as well as effectiveness in construction in providing a compact and effective organization to permit an operator to selectively lift a commode seat in cooperation with a flushing procedure of a commode and in this respect, the present invention substantially fulfills this need.

SUMMARY OF THE INVENTION

In view of the foregoing disadvantages inherent in the known types of commode apparatus now present in the prior art, the present invention provides a commode flush and seat lift apparatus wherein the same provides independent lever structure cooperative through associated shaft organizations to provide a compact and effective mechanical linkage to effect selective seat lifting and flushing of an associated commode. As such, the general purpose of the present invention, which will be described subsequently in greater detail, is to provide a new and improved commode flush and seat lift apparatus which has all the advantages of the prior art commode apparatus and none of the disadvantages.

To attain this, the present invention provides an apparatus including a conduit arrangement directing linkage to individually and selectively lift a toilet seat in cooperation with a flush lever of a commode organization to minimize manual contact with the commode apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode flush and seat lift apparatus which has all the advantages of the prior art commode apparatus and none of the disadvantages.

It is another object of the present invention to provide a new and improved commode flush and seat lift apparatus which may be easily and efficiently manufactured and marketed.

It is a further object of the present invention to provide a new and improved commode flush and seat lift apparatus which is of a durable and reliable construction.

An even further object of the present invention is to provide a new and improved commode flush and seat lift apparatus which is susceptible of a low cost of manufacture with regard to both materials and labor, and which accordingly is then susceptible of low prices of sale to the consuming public, thereby making such commode flush and seat lift apparatus economically available to the buying public.

Still yet another object of the present invention is to provide a new and improved commode flush and seat lift apparatus which provides in the apparatuses and methods of the prior art some of the advantages thereof, while simultaneously overcoming some of the disadvantages normally associated therewith.

Still another object of the present invention is to provide a new and improved commode flush and seat lift apparatus wherein the same avoids unsanitary contact with an associated commode structure minimizing transmittal of various viral and bacteriological diseases.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
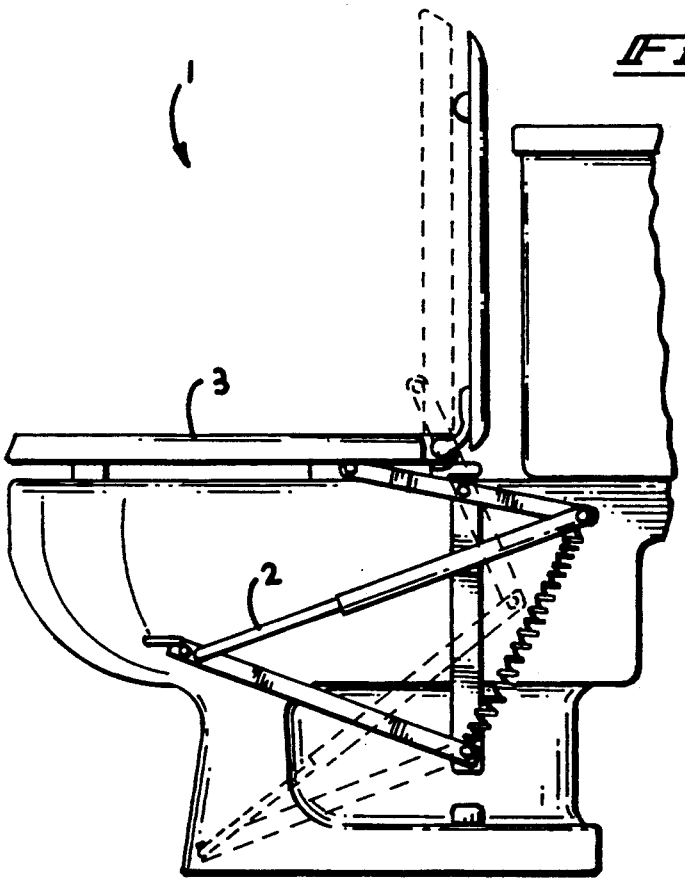
FIG. 1 is an orthographic side view, taken in elevation, of a prior art commode apparatus.

With reference now to the drawings, and in particular to FIGS. 1 to 7 thereof, a new and improved commode flush and seat lift apparatus embodying the principles and concepts of the present invention and generally designed by the reference numeral 10 will be described.

Figure 2:
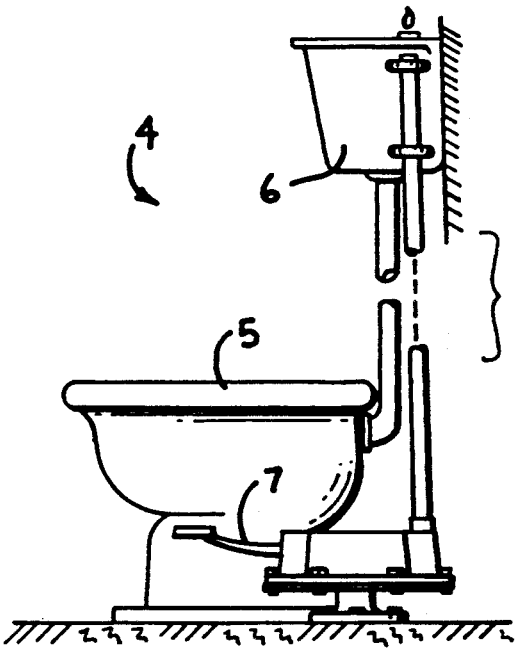
PRIOR ART FIG 2
FIG. 2 is an orthographic side view, taken in elevation, of a further prior art commode apparatus.
Figure 3:
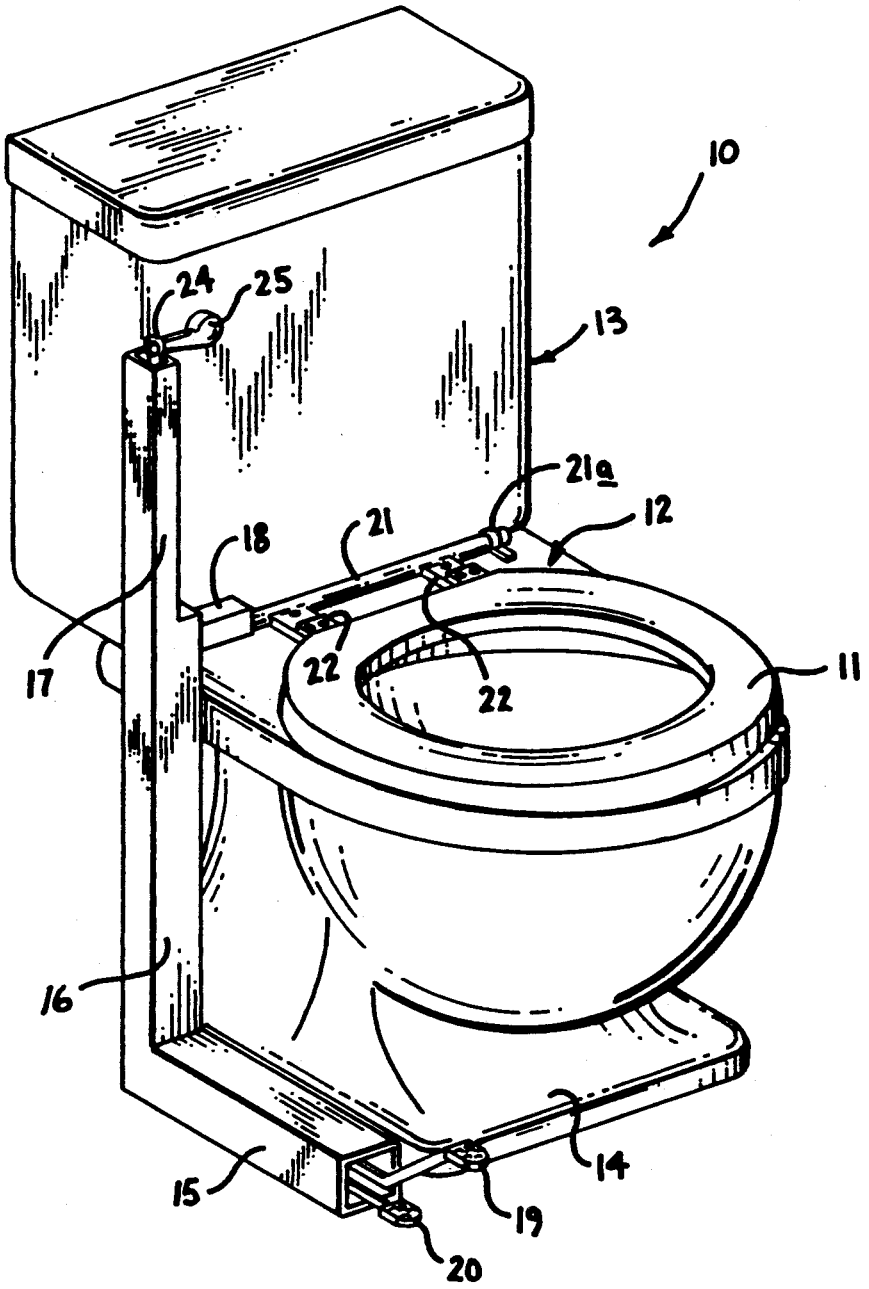
FIG. 3 is an isometric illustration of the instant invention.
Figure 4:
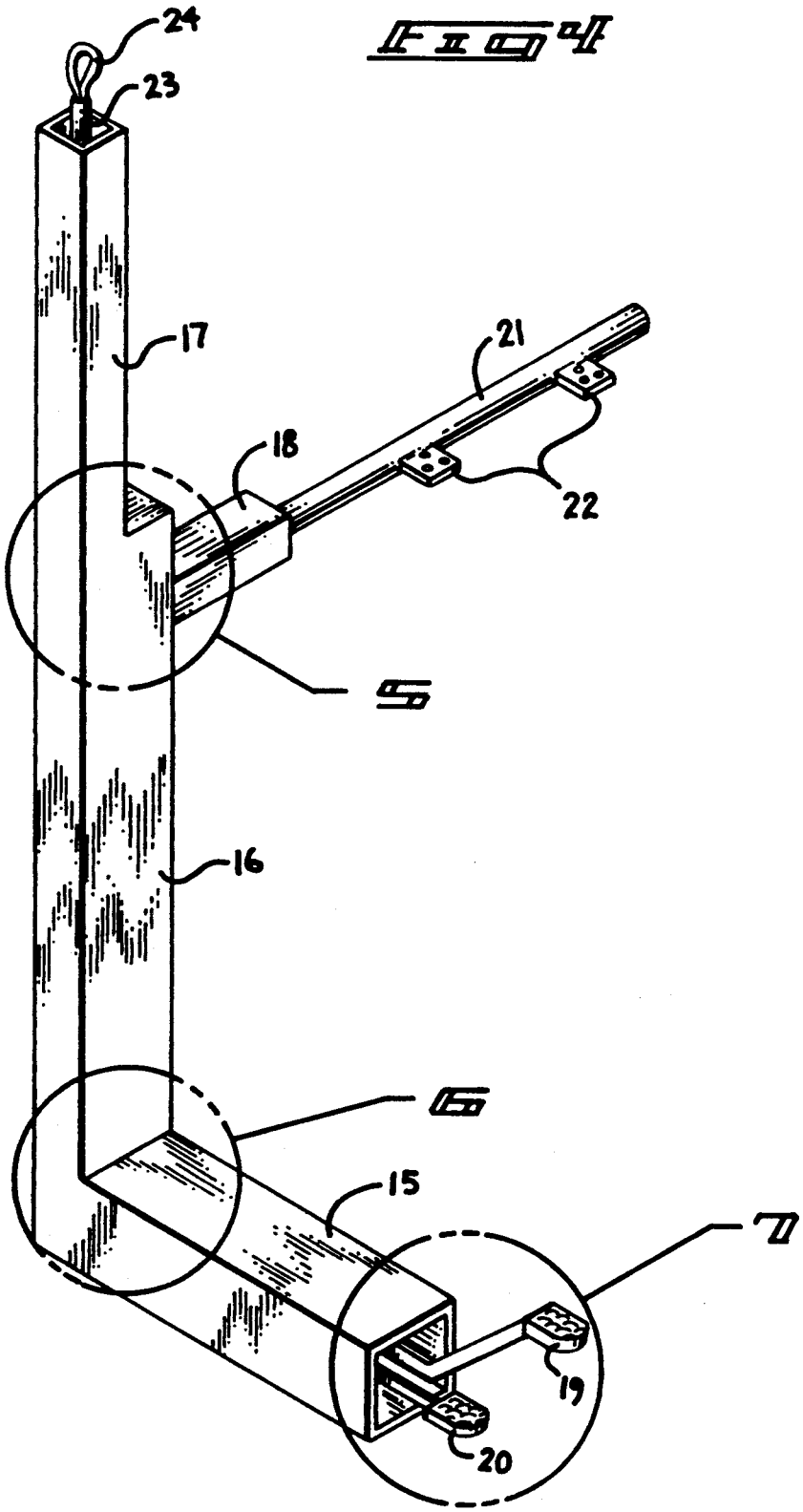
FIG. 4 is an isometric illustration, somewhat enlarged, of the lift structure in association with a conventional commode.

FIG. 1 illustrates a prior art commode apparatus 1, wherein a linkage structure 2 effects lifting of a commode lid and seat structure 3, wherein as typical in such prior art structure, the organization in linkage 2 requires spacing in a physical envelope substantially encompassing an entire side portion of the associated commode. FIG. 2 illustrates a further prior art construction wherein a flush organization 4 includes a lever 7 positioned adjacent a commode 5 that cooperates with a chain structure to effect flushing of an associated commode tank 6.

More specifically, the commode flush and seat lift apparatus 10 of the instant invention essentially comprises a commode structure 12 including a commode lid 11 mounted thereon, with a commode fluid tank 13 mounted to the commode 12 to include a fluid reservoir in a conventional manner, with a flush lever 25 in operative association with the fluid tank 13 to effect a selective flushing of the commode 12. The commode 12 includes a commode base 14, with the organization of the instant invention including a first conduit 15 directed in a horizontal orientation relative to the commode base, with a second conduit 16 arranged vertically in communication with the first conduit, and a third conduit 17 projecting longitudinally of and beyond the second conduit 16. A fourth conduit 18 is directed in overlying relationship relative to an upper surface of the commode 12, with a first shaft 21 in cooperation with a seat lift pedal 19 to effect a lifting of the commode lid 11, while a second shaft 23 projecting interiorly within the second and third conduits 16 and 17 is in mechanical communication with the flush pedal 20 and the flush lever 25.

A plurality of plates 22 orthogonally mounted to the first shaft 21 and to a rear surface of the commode lid 11 permit rotation of the lid 11 upon a like rotation of the first shaft 21. The second shaft 23 directed through the second and third conduit 16 and 17 and aligned therewith includes a clamp member 24 at an upper terminal end of the second shaft 23 defined as a clamp-on securement loop 24 for mounting about the flush lever 25, whereupon a downward reciprocation of the second shaft 23 effects a flushing of the commode 12 by the fluid tank 13.

Figure 5:
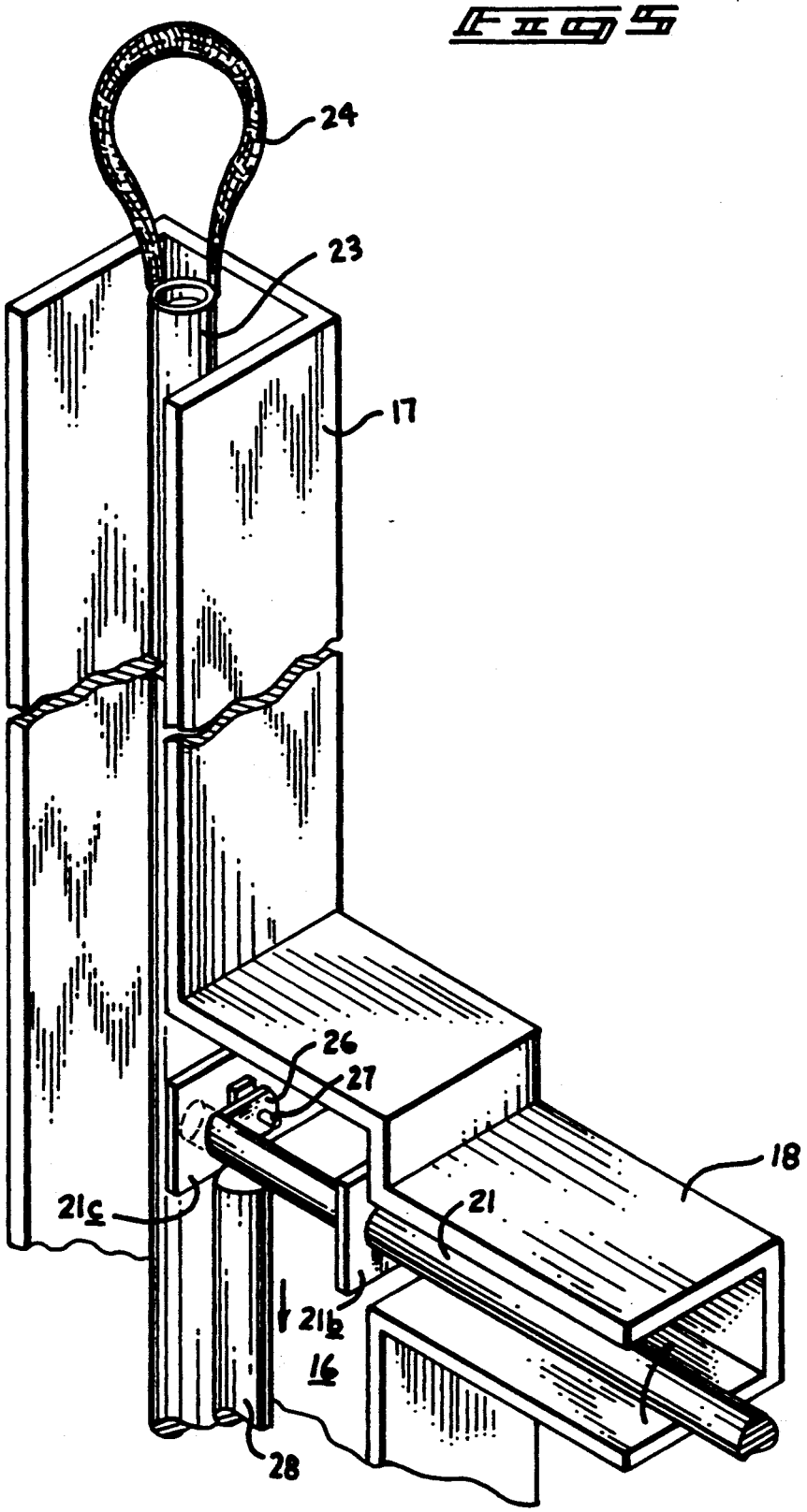
FIG. 5 is an isometric illustration, partially in section and enlarged, of section 5 as illustrated in FIG. 4.

Reference to FIG. 5 notes the first shaft 21 orthogonally directed from the second conduit 16 and longitudinally aligned medially of the fourth conduit 18, including a first shaft first support journal 21*a* mounted to the commode 12, with a respective second and third first shaft support journal 21*b* and 21*c* mounted in alignment with the fourth conduit 18 within the second conduit 16 rotatably mounting and aligning the first shaft therewithin. The first shaft further includes a first shaft flange 2 positioned between the second and third support journals 21*b* and 21*c* of the first shaft 21 mounted integrally thereto in an orthogonally orientation, including a first shaft support axle 27 rotatably and pivotally mounting an upper terminal end of a third shaft 28 relative to the first shaft flange 26. As illustrated, downward reciprocation of the third shaft 28 effects rotation of the first shaft 21 to effect a lifting of the lid 11.

Figure 6:
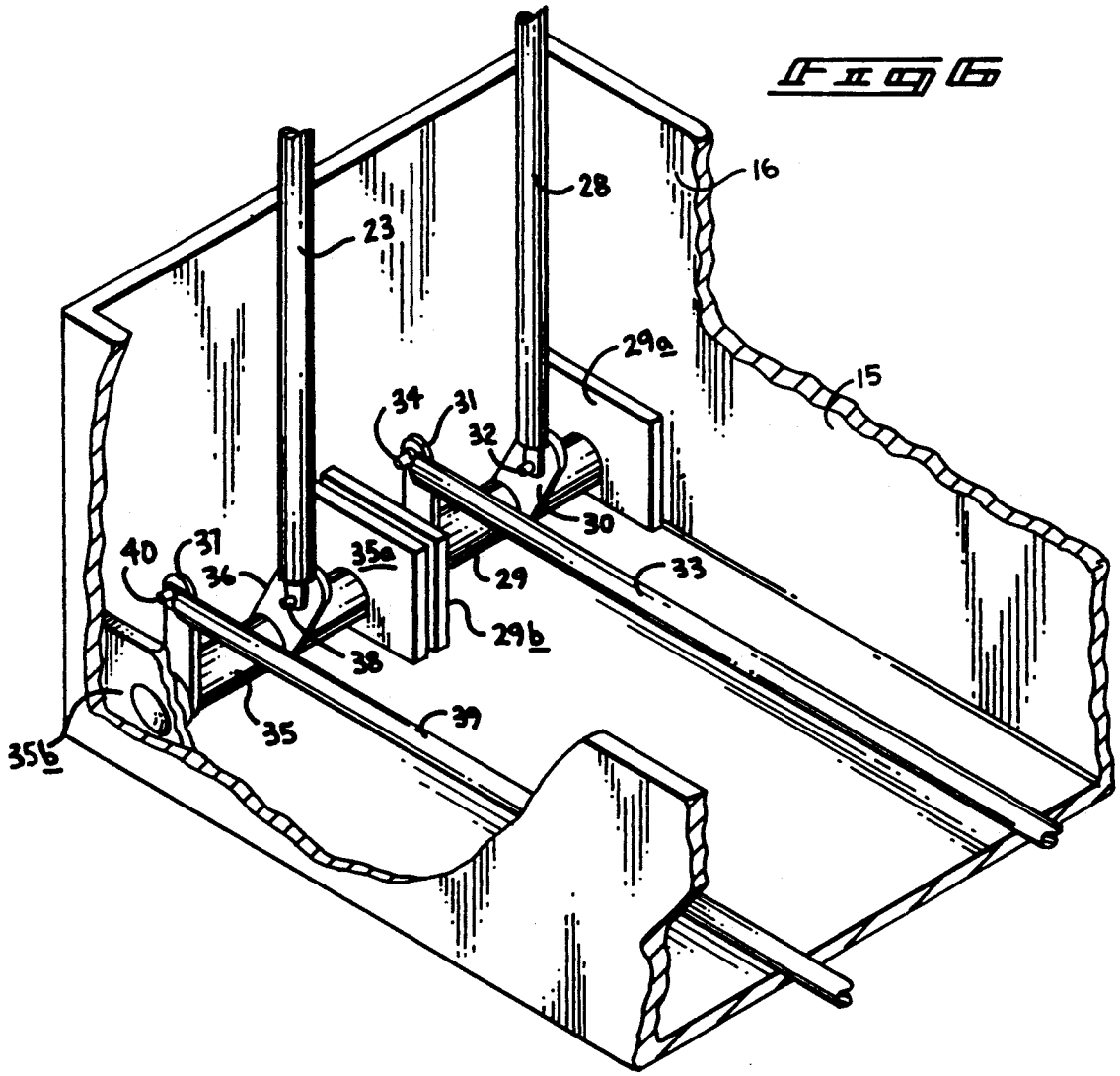
FIG. 6 is an isometric illustration, partially in section and enlarged, of section 6 as set forth in FIG. 4.

At an intersection defined by the intersection of the first and second conduits 15 and 16 respectively, a first linkage means is provided and includes a fourth shaft 29 and a fifth shaft 33 positioned in alignment relative to one another and arranged orthogonally relative to the longitudinal orientation of each of the first and second conduits. The fourth shaft 29 is mounted within a respective fourth shaft first and second support journal 29*a* and 29*b* rotatably, with a fourth shaft first flange 30 orthogonally mounted to the fourth shaft, with a fourth shaft second flange 31 also orthogonally mounted to the fourth shaft angularly displaced relative to the fourth shaft first flange. A lower terminal end of the third shaft 28 includes a third shaft support axle 32 to pivotally anchor and mount a lower terminal end of the shaft 32 to the fourth shaft first flange 30. A fifth shaft 33 longitudinally aligned within the first conduit 15 includes a fifth shaft rear support axle 34 to pivotally anchor the rear terminal end of the fifth shaft 33 to the fourth shaft second flange 31. Accordingly, a second linkage means in the form of the sixth shaft 35 includes a sixth shaft first flange 36 orthogonally and integrally mounted to the sixth shaft 35, including a second shaft axle 38 pivotally anchoring the lower terminal end of the second shaft 23 to the sixth shaft first flange 36. Further, a seventh shaft 39 includes a rear terminal end, with a seventh shaft rear support axle 40 anchoring the rear terminal end of the seventh shaft 39 to the sixth shaft second flange 37. It is noted that a sixth shaft first and second support journal 35*a* and 35*b* aligned with the fourth shaft first and second support journals 29*a* and 29*b* rotatably mount opposed terminal ends of the sixth shaft 35, as illustrated in FIG. 6.

Figure 7:
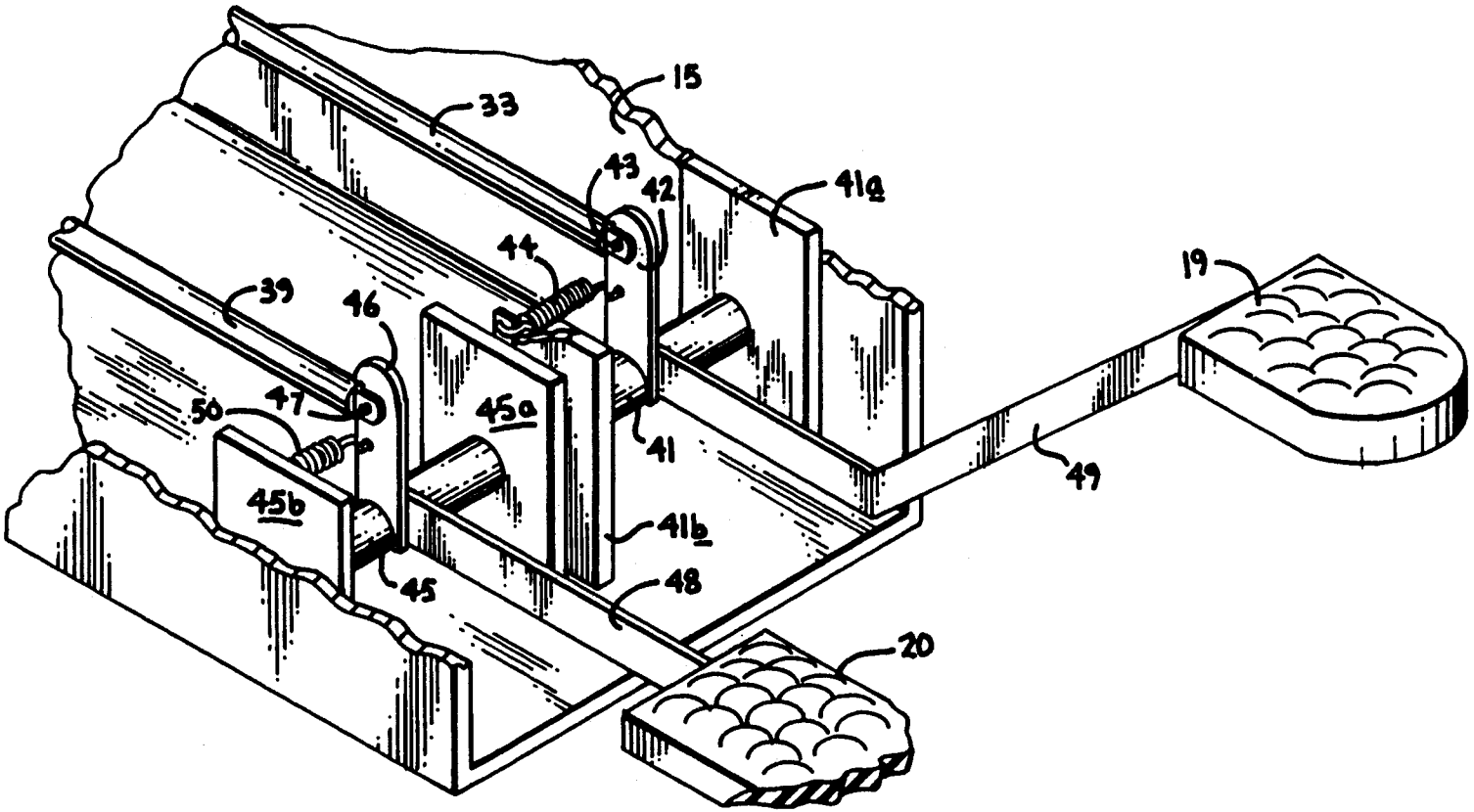
FIG. 7 is an isometric illustration, partially in section and enlarged, of section 7 as set forth in FIG. 4.

Reference to FIG. 7 illustrates the entrance to the first conduit 15, including an eighth shaft 41 orthogonally aligned relative to the conduit 15 coaxially aligned with a ninth shaft 45. The eighth shaft 41 is rotatably mounted within a respective eighth shaft first and second support journal 41*a* and 41*b*, with the ninth shaft 45 rotatably mounted within respective first and second ninth shaft support journals 45*a* and 45*b*, with the support journals of the eighth and ninth shafts aligned relative to one another, as illustrated in FIG. 7. The eighth shaft 41 includes an eighth shaft flange 42 integrally mounted in orthogonal relationship relative to the eighth shaft 41, with a fifth shaft forward support axle 43 pivotally anchoring a forward terminal end of the fifth shaft 33 to an upper terminal end of the eighth shaft flange 42. The seat lift pedal 19 includes a seat lift pedal angulated length 49 to space the seat lift pedal 19 above the flush pedal 20, whereupon depressing of the seat lift pedal 19 rotates the eight shaft flange 42 and accordingly rotates the fourth shaft 29 through the fifth shaft 33 to effect subsequent rotation of the first shaft 21 and a consequent lifting of the commode lid 12 in a rotative manner relative to the commode 12. A forward terminal end of the seventh shaft 39 includes a seventh shaft forward support axle 47 to pivotally anchor the forward terminal end of the seventh shaft 39 to a ninth shaft flange 46 that is integrally and orthogonally mounted to the ninth shaft 45. Depressing of the flush pedal 20 mounted to a flush pedal link 48 effects rotation of the ninth shaft flange 46 to effect rotation of the sixth shaft 35 and downward reciprocation of the second shaft 23 and effect flushing of the commode fluid tank 13 through the flush lever 25. An eighth shaft flange return spring 44 mounted to the eighth shaft flange 42 effects orientation of the eighth shaft flange in an initial position prior to rotation of the eighth shaft 41 to a second position to effect lifting of the commode lid, while a ninth shaft flange return spring 50 maintains orientation of the ninth shaft flange 46 in a like initial orientation to present the associated flush pedal 20 in an initial first position prior to rotation of the ninth shaft 45 to a second position to effect flushing of the commode fluid tank 13 in a manner as noted above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode flush and seat lift apparatus comprising, in combination, a commode including a lid overlying the commode, with a fluid tank positioned rearwardly of the lid, with the fluid tank including a flush lever pivotally mounted to the fluid tank to effect a flushing of the commode, wherein the apparatus further includes, a first shaft mounted to the commode rearwardly of the lid, wherein the first shaft includes a plurality of spaced plates orthogonally and fixedly mounted to the first shaft and mounted to a rear end face of the lid, wherein rotation of the first shaft effects rotation of the lid, and a second shaft orthogonally oriented relative to the first shaft, wherein the second shaft includes a clamp member mounted to an upper terminal end of the second shaft with the clamp member mounted to the flush lever, and the commode including a commode base, with a seat lift pedal positioned adjacent a lower terminal end of the commode base, including first linkage means for effecting rotation of the first shaft upon depressing of the seat lift pedal, and a flush pedal including second linkage means for effecting downward reciprocation of the second shaft upon depressing of the flush pedal, and wherein the apparatus includes a first conduit orthogonally oriented to and integrally mounted to a second conduit, wherein the second conduit projects upwardly relative to the first conduit, and a third conduit projecting longitudinally of and beyond the second conduit, and a fourth conduit projecting orthogonally relative to the second conduit, and the first shaft is rotatably mounted within and extends beyond the fourth conduit, wherein the first linkage means is wholly contained within the second conduit and the first conduit, and the second shaft is reciprocatably mounted within the third conduit and second conduit, with the second linkage means wholly contained within the first conduit.

2. An apparatus as set forth in claim 1 wherein the first shaft includes a first shaft first support journal mounted rearwardly of the lid and secured to the commode, with a second support journal and a third support journal positioned within the second conduit in alignment with the first journal and with the fourth conduit, and a first shaft flange orthogonally and integrally mounted to the first shaft intermediate the first shaft second support journal and the first shaft third support journal, and the first shaft flange pivotally mounted to the first linkage means, the first linkage means including a third shaft, wherein the first shaft flange is mounted pivotally to an upper terminal end of the third shaft, and further including a fourth shaft mounted at an intersection defined by the first conduit and the second conduit, and a lower terminal end of the third shaft pivotally mounted to the fourth shaft, and the fourth shaft including a fifth shaft pivotally mounted thereto, with the fifth shaft spaced from and orthogonally arranged relative to the third shaft, and the fifth shaft extending longitudinally of the first conduit in mechanical association with the seat lift pedal.

3. An apparatus as set forth in claim 2 wherein the second linkage means includes a sixth shaft aligned with the third shaft, the sixth shaft including a sixth shaft first flange, with the sixth shaft first flange pivotally mounting a lower terminal end of the second shaft, and the sixth shaft including a sixth shaft second flange angularly displaced relative to the first flange fixedly and orthogonally mounted to the sixth shaft, with the sixth shaft second flange including a seventh shaft mounted thereto, the seventh shaft including a rear terminal end, the rear terminal end mounted to the sixth shaft second flange, and the seventh shaft longitudinally aligned and parallel relative to the fifth shaft, with a forward terminal end of the seventh shaft mechanically mounted to the flush pedal.

4. An apparatus as set forth in claim 3 wherein the fourth shaft and the sixth shaft are coaxially aligned relative to one another.

5. An apparatus as set forth in claim 4 wherein the forward terminal end of the fifth shaft includes a fifth shaft forward support axle, the fifth shaft forward support axle pivotally mounted to an eighth shaft flange, the eighth shaft flange orthogonally and integrally mounted to an eighth shaft, and the seat lift pedal including a flush pedal link mounted fixedly and orthogonally to the eighth shaft to effect relative rotation of the eight shaft.

6. An apparatus as set forth in claim 5 including a ninth shaft, the ninth shaft coaxially aligned with the eighth shaft, the ninth shaft including a ninth shaft flange, the ninth shaft flange pivotally mounted to a forward terminal end of the seventh shaft, and the flush pedal including a flush pedal link integrally and orthogonally mounted to the ninth shaft to effect selective rotation of the ninth shaft.

7. An apparatus as set forth in claim 6 wherein the eight shaft flange includes an eighth shaft flange return spring.

* * * * *